US005618034A

United States Patent [19]

Takashimizu

[11] Patent Number: 5,618,034

[45] Date of Patent: Apr. 8, 1997

[54] SUPPLY/CONVEYANCE MECHANISM FOR SHEETS OF PAPER

[75] Inventor: Yoshihiro Takashimizu, Kawasaki, Japan

[73] Assignee: Fujitsu Limited, Kawasaki, Japan

[21] Appl. No.: 614,647

[22] Filed: Mar. 13, 1996

Related U.S. Application Data

[62] Division of Ser. No. 293,592, Aug. 22, 1994, Pat. No. 5,533,721.

[30] Foreign Application Priority Data

Nov. 5, 1993 [JP] Japan ..... 5-277045

[51] Int. Cl.[6] ..... B65H 31/00

[52] U.S. Cl. ..... 271/209; 271/207

[58] Field of Search ..... 271/207, 209, 271/161, 110

[56] References Cited

U.S. PATENT DOCUMENTS

| | | | |
|---|---|---|---|
| 4,361,319 | 11/1982 | Ikeda et al. | 271/209 |
| 4,511,135 | 4/1985 | Huerta et al. | 271/126 |
| 4,711,442 | 12/1987 | Runzi | 271/171 |
| 4,836,526 | 6/1989 | Melnik | 271/209 |
| 5,094,442 | 3/1992 | Kamprath et al. | 271/265.03 |

FOREIGN PATENT DOCUMENTS

| | | | |
|---|---|---|---|
| 667829 | 11/1938 | Germany . | |
| 3311236 | 10/1983 | Germany . | |
| 57-013036 | 1/1982 | Japan . | |
| 57-093836 | 6/1982 | Japan . | |
| 0198252 | 11/1984 | Japan | 271/209 |
| 63-016941 | 1/1987 | Japan . | |
| 0211267 | 9/1987 | Japan | 271/209 |
| 4-112161 | 4/1992 | Japan | 271/207 |
| 6-156853 | 6/1994 | Japan | 271/209 |

*Primary Examiner*—H. Grant Skaggs
*Attorney, Agent, or Firm*—Staas & Halsey

[57] ABSTRACT

A supply/conveyance mechanism for sheets includes: a hopper section (10) for accommodating a plurality of sheets stacked in layers; conveyer (20, 40) for picking up the sheets one by one or in groups of a predetermined number of sheets from the hopper section and conveying the sheets in an advancing direction along a predetermined passage; two detectors (60) for optically detecting a fore end of the sheet in the process of conveyance; correcting device (24, 25) for correcting a direction of the sheet in accordance with the results of detection of said detectors; and right and left guide plates (12) provided in the hopper section (10) for regulating both sides of stacked sheets. The guide plates (12) are capable of sliding in a horizontal direction perpendicular to the sheet advancing direction. The guide plates are also respectively connected with the two detectors (60), so that the detectors (60) are also capable of sliding in the horizontal direction perpendicular to the advancing direction of the sheet together with said pair of guide plates (12).

6 Claims, 8 Drawing Sheets

SUPPLY/CONVEYANCE MECHANISM FOR SHEETS OF PAPER

This application is a division of application Ser. No. 08/293,592, filed Aug. 22, 1994, now U.S. Pat. No. 5,533, 721.

BACKGROUND OF THE INVENTION

1. Field of the Invention

The present invention relates to a supply/conveyance mechanism for sheets, such as printable material or printed material, by which a plurality of sheets stacked in layers are successively supplied or conveyed, in alignment, one by one.

2. Description of the Related Art

An automatic document feeder is used in mechanisms, such as a facsimile machine, a copier or an image scanner having an image input section through which document images are input. According to the automatic document feeder, a large number of documents stacked in a hopper can be automatically processed. Therefore, automatic document feeders are widely used in offices and used for various purposes.

Such an automatic sheet feeder includes a hopper in which documents or sheets are stacked; a picking section in which documents are picked up one by one by a picking roller or the like; a separating section for preventing double feeding of documents sent from the picking section; a processing section in which the documents sent from the picking section are subjected to the process of reading or printing; a stacking section in which the processed documents are stacked; and a conveyance section for conveying the documents from the separating section to the stacking section through the processing section. Further, it is required to provide a driving section composed of a motor for driving these sections, a sensor section for detecting the positions of documents, and a control section for controlling these sections. By the actions of these sections described above, images on the document can be precisely read and input.

In the conventional supply/conveyance mechanism for sheets, the stacking of documents is improved in the following manner.

In the case of a low speed machine in which sheets of paper of regular sizes, such as A4 size and A5 size, are handled, a sheet stacking surface in the stacking section is inclined by an angle of 15° to prevent the documents from dropping. Alternatively, when a gap between the sheet guides of the discharge section is formed into a V-shape so that the discharged documents are intentionally curved for enhancing the rigidity thereof, and thereby the rotation and inversion of documents can be avoided. Alternatively, a small document stopper is provided for preventing the documents from being scattered in the process of stacking.

However, since the conveyance speed of recent apparatus is high and the number of documents to be processed is also high, and since it is required to process documents of various sizes, from small documents of A8 size to relatively large documents of A3 size, the conventional measures described above are not sufficient to meet the demands.

Concerning the skew of conveyed documents, in the case of a low speed machine, after the document has begun to feed, the rotation of the conveyance roller is stopped, so that a front end, or leading edge, of the stopped document comes into contact with the conveyance roller. In this way, the leading edge of the document is aligned with the conveyance roller. Therefore, any skew of the document can be reduced. However, in the case of a high speed machine, a large amount of time is required for the aligning operation, and the documents flutter because the document conveyance speed is high. Therefore, the aligning effect is relatively low. For this reason, it is difficult to adopt the aforementioned aligning operation.

SUMMARY OF THE INVENTION

An object of the present invention is to provide a supply/conveyance mechanism for sheets in which the occurrence of skew of the sheets can be prevented in the case where a plurality of stacked sheets are successively supplied or conveyed, in alignment, one by one.

Another object of the present invention is to provide a supply/conveyance mechanism for sheets in which the sheets are stacked in alignment and without being scattered, in the case where the sheets are successively stacked in the stacking section.

According to one aspect of the present invention, there is provided a supply/conveyance mechanism for sheets comprising a hopper section for accommodating a plurality of sheets stacked in layers; conveyance means for picking up the sheets, one by one, from said hopper section and conveying the picked sheets in an advancing direction along a predetermined passage; at least two detectors for detecting a front end, or leading edge, of each advancing sheet while in the process of conveyance; correcting means for correcting a direction of the sheet in accordance with the detection results of said detectors; and a pair of guide plates provided in said hopper section for regulating both sides of said stacked sheets, said pair of guide plates being capable of sliding in a horizontal direction perpendicular to the advancing direction of the sheet and said pair of guide plates being respectively connected with said two detectors, so that said detectors are also capable of sliding in the horizontal directions perpendicular to the advancing direction of the sheet, together with said pair of guide plates.

Whether a sheet of paper is skewed or not, is judged by a difference between the respective times at which the two detectors detect a front end of the sheet. In the case where large sheets of paper are used, the distance between the right and left guides is increased and the distance between the two detectors is also increased. Therefore, it is possible to integrally adjust an interval between the right and left guide plates and a distance between the right and left detectors, so that the skew of a sheet of paper can be precisely detected in accordance with the size of the sheet. When the adjusting time for skew is changed in accordance with the difference in the detection times between the two detectors, the processing time can be reduced.

According to another aspect of the present invention, there is provided a supply/conveyance mechanism for sheets comprising a hopper section for accommodating a large number of sheets stacked in layers; a picking means for taking out the sheets from said hopper section; conveyance means for conveying said sheets, taken out by said picking roller, in an advancing direction along a predetermined passage; a pair of guide plates provided in said hopper section for regulating both sides of said stacked sheets, said guide plates being capable of sliding in a horizontal direction perpendicular to the advancing direction of the sheet; and a pair of guide rollers for pressing the uppermost sheet on the opposite side portion of thereof, on the upstream side of said picking means with respect to the conveyance direction and wherein said pair of guide rollers are respectively connected with said pair of guide plates, and are also slidable in the horizontal direction, perpendicular to the advancing direction of the sheet, together with said pair of guide plates.

In the case where sheets of paper of a large size are used, the distance between the right and left guide rollers is extended as the distance between the right and left guide plates is extended. On the contrary, the distance between the right and left guide plates is reduced in the case where sheets of paper of a small size are used. Therefore, in accordance with the size of the sheets of paper currently being handled, the uppermost portions on both sides of the sheets can be pressed, so that the sheets of paper can be prevented from rising upward. Accordingly, the skew of sheets can be also prevented in the process of conveyance.

According to still another aspect of the present invention, there is provided a supply/conveyance mechanism for sheets comprising: a conveyance means for conveying sheets one by one or by a predetermined number of sheets along a predetermined passage; a discharging roller for discharging the conveyed sheets; and a stacking section for stacking the sheets discharged by said discharging roller, wherein the stacking surface of the stacking section is inclined in such a manner that an upstream portion of the stacking surface is lower than the discharging position of the discharging roller with respect to the discharging direction, and the stacking surface is inclined upward as it goes to the downstream side, and a section of the stacking surface in a direction perpendicular to the discharging direction is formed in such a manner that the section is approximately concave at the upstream side and the section gently changes to convex at the downstream side.

The stacking surface of the stacking section is formed in the following manner:

The position of the stacking surface on the upstream side, with respect to the discharging direction, is lower than the discharging position of the discharging roller. The stacking surface is inclined upward as it goes to the downstream side. Concerning a section of the stacking surface with respect to the discharging direction, the section on the upstream side is formed approximately concave, and as it goes to the downstream side, the section is changed to be horizontal, and then gently changed to be convex. Accordingly, when the sheets of paper are discharged and dropped from the discharging roller, they are slightly deformed by the configuration of the stacking surface. Due to the foregoing, it is possible to prevent the sheets of paper from scattering, and they can be aligned in a good condition.

DETAILED DESCRIPTION OF THE PREFERRED EMBODIMENTS

Figure 1:
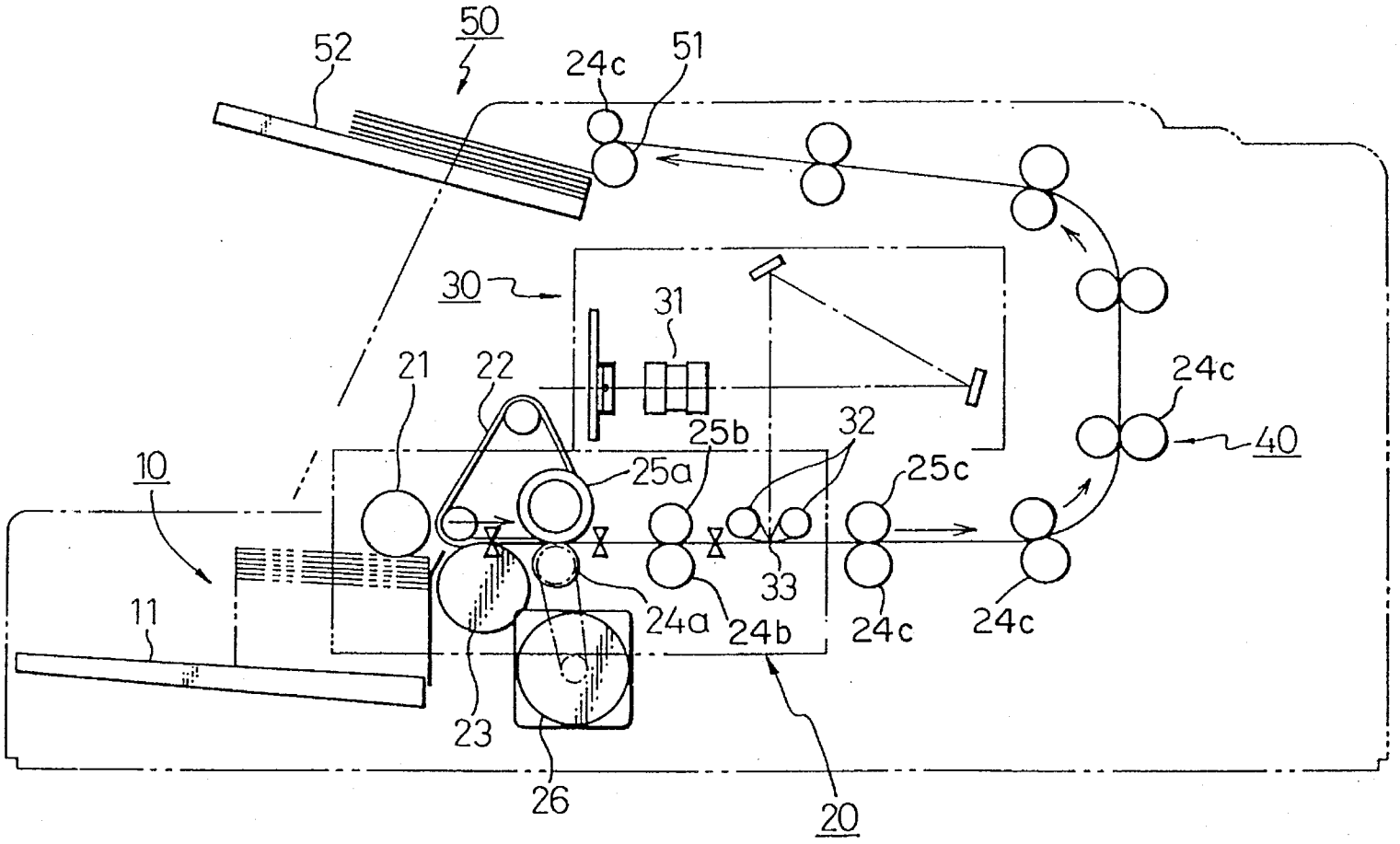
Fig. 1 (PRIOR ART)
FIG. 1 is a schematic illustration of a conventional document reading device to which the present invention can be applied.
Figure 2:
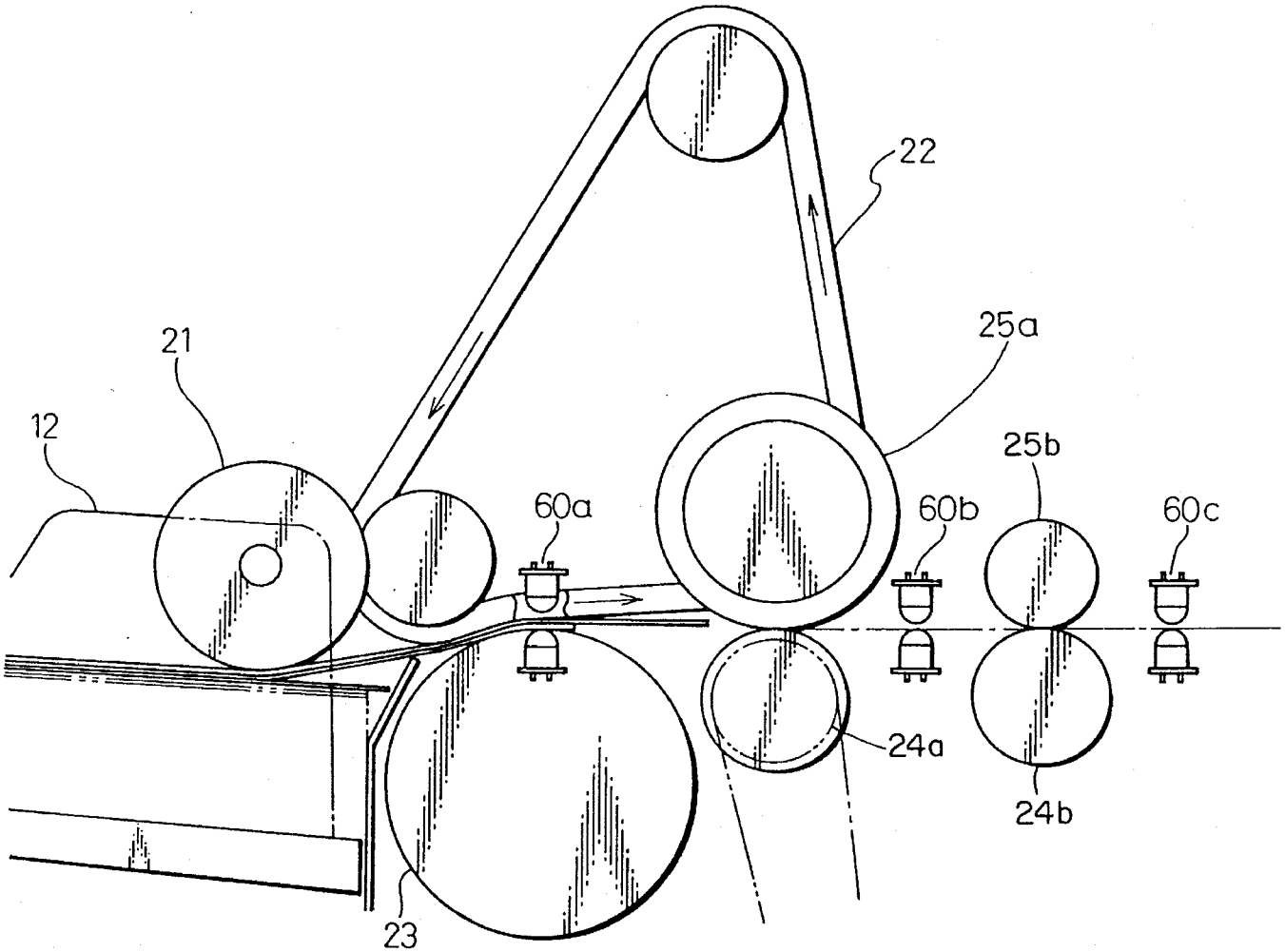
Fig. 2 (PRIOR ART)
FIG. 2 is a side view of the conventional document supply and conveyance mechanism.
Figure 3:
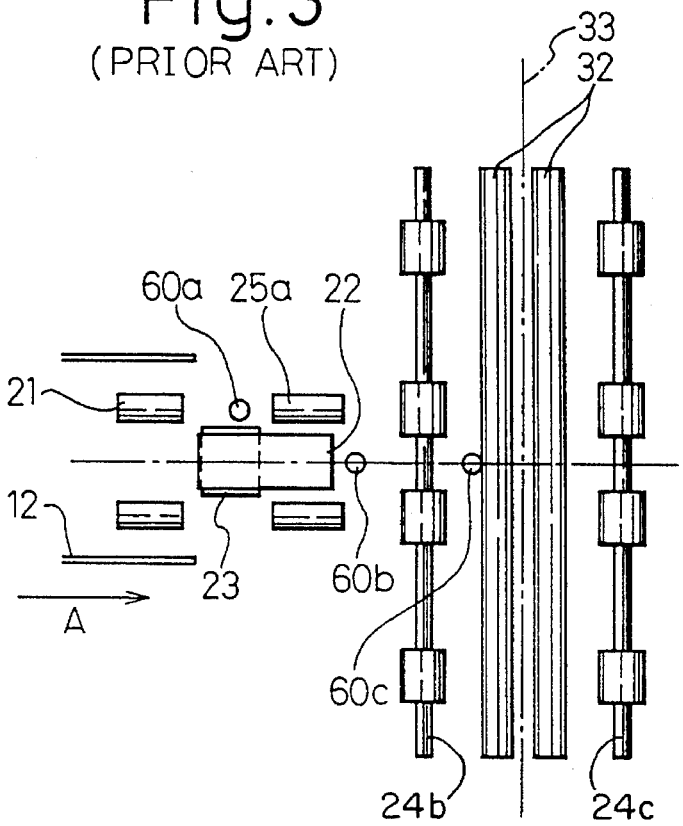
Fig.3 (PRIOR ART)
FIG. 3 is a plan view of the conventional document supply and conveyance mechanism.

First, with reference to FIGS. 1 to 3, a conventional document supply and conveyance mechanism will be explained as follows. FIG. 1 is a schematic illustration of a document reading device, FIG. 2 is a side view of the conventional document supply and conveyance mechanism, and FIG. 3 is a plan view of the conventional document supply and conveyance mechanism.

In these drawings, numeral 10 is a document supply section, numeral 20 is a document conveyance section by which documents are conveyed to a document reading position, numeral 30 is an optical reading section, numeral 40 is a document conveyance section by which documents are conveyed after they have been read, and numeral 50 is a document discharging and stacking section.

In the document supply section 10, numeral 11 is a hopper on which a plurality of documents are accommodated in a stack. Numeral 12 denotes right and left guide plates for regulating both sides of the sheets of paper stacked on the hopper. In the document conveyance section 20, numeral 21 denotes a pair of picking rollers for picking the documents in the hopper in a direction indicated by arrow A of FIG. 3, numeral 22 is a separator belt, numeral 23 is a reverse roller which prevents the double feeding of documents in cooperation with a separator roller, numerals 24*a* and 24*b* are conveyance rollers, numerals 25*a* and 25*b* are pinch rollers, and numeral 26 is a motor for driving the conveyance roller 24*a*.

In the optical reading section 30, numeral 31 is an optical unit, numeral 32 is a light source, such as fluorescent lamps, and numeral 33 is a document reading position. After reading, documents are conveyed by the plural conveyance rollers 24*c* in the conveyance section 40, and stacked on a stacking surface of the stacking section 52 by the discharging roller 51 in the document discharging and stacking section 50. Numerals 60*a* to 60*c* are optical transmission type sensors for detecting the front end (i.e., leading edge) of each advancing document so that each conveyance roller and the optical reading section are controlled.

Figure 4:
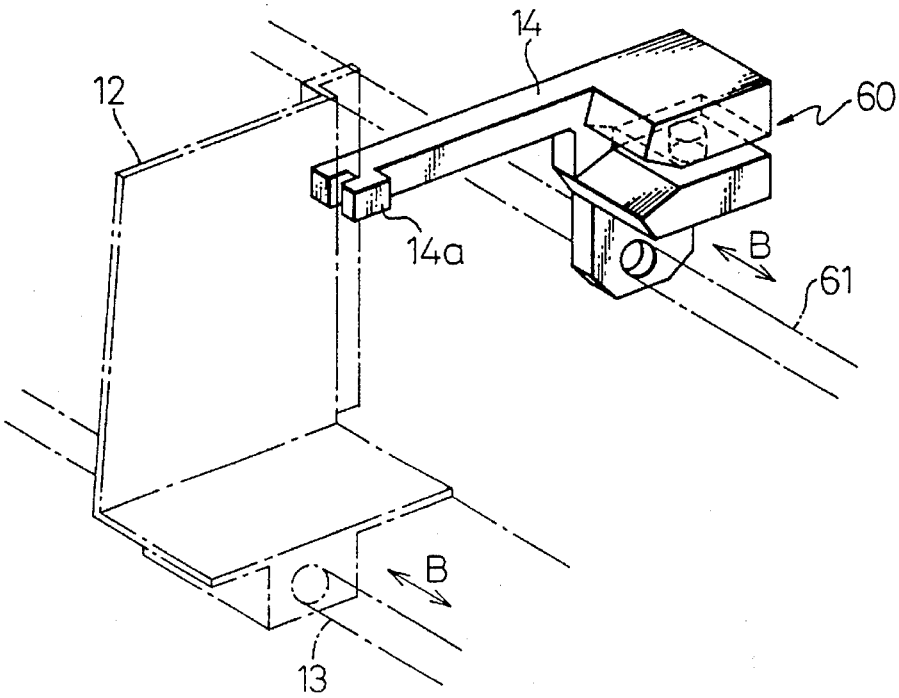
FIG. 4 is a perspective view of a first embodiment of the present invention.
Figure 5:
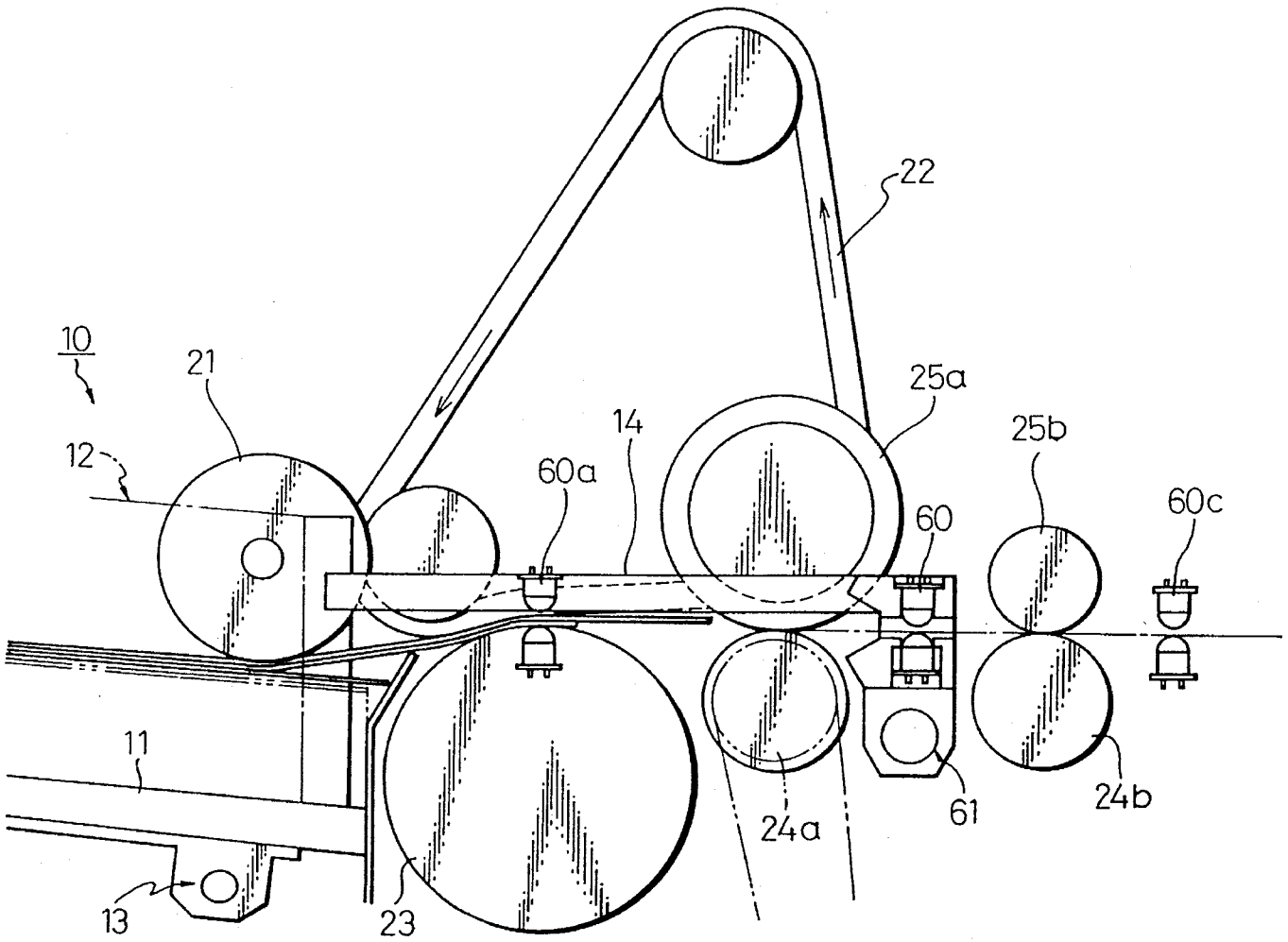
FIG. 5 is a side view of the document supply and conveyance mechanism relating to the first embodiment.
Figure 6:
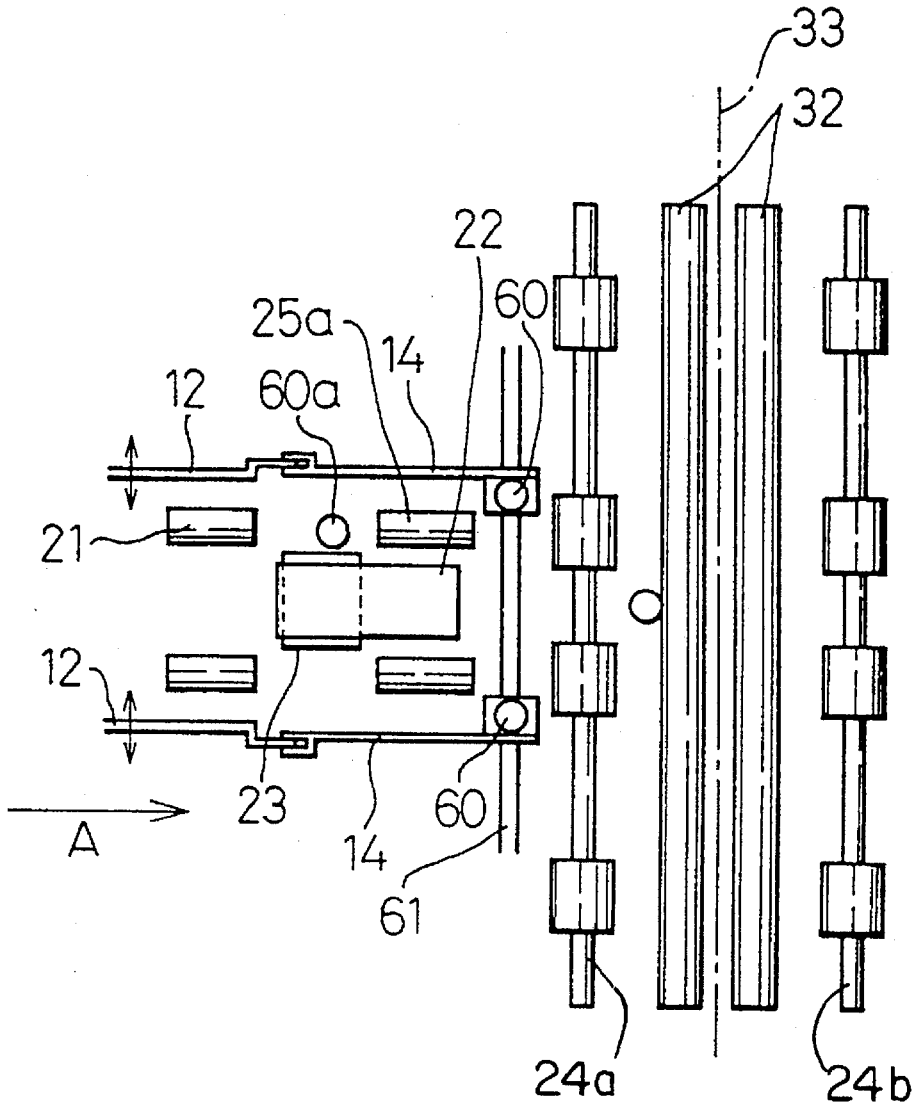
FIG. 6 is a plan view of the first embodiment.

Next, with reference to FIGS. 4 to 6, a first embodiment of the present invention will be explained as follows. FIG. 4 is a perspective view of the first embodiment of the present invention, FIG. 5 is a side view of the document supply and conveyance mechanism relating to the first embodiment, and FIG. 6 is a plan view of the first embodiment. The same or corresponding parts in each of FIGS. 1 to 6 are identified by the same reference characters, and the explanations of these parts are omitted here.

As illustrated in FIGS. 4 to 6, there are provided right and left guide plates 12, 12 for regulating (i.e., guiding) the respective, opposite sides of the sheets of paper stacked on the hopper 11. The right and left guide plates 12, 12 are provided in such a manner that they can be slidingly moved along a shaft 13 in the horizontal direction B perpendicular to the sheet advancing direction A. On the other hand, two optical transmission type or reflection type photosensors 60, 60 for detecting respective, spaced positions of the fore end of the document, are provided on a shaft 61 so that the photosensors 60, 60 can be slidingly moved in the horizontal direction B perpendicular to the sheet advancing direction A. The right and left guide plates 12, 12 are respectively connected with the photosensors 60, 60 through connecting members 14, 14. That is to say, as shown in FIG. 4, each of the connecting members 14, 14 has a Y-shaped end portion 14*a* which is slidably engaged with a front edge of the corresponding guide plate 12. Thus, each guide plate 12 is allowed to be raised or lowered in accordance with a vertical movement of the hopper 11 depending on the amount of sheets supported in the hopper 11.

Due to the foregoing construction, the right and left guide plates 12, 12 can be slidingly moved in the direction of arrow B in accordance with the size of the document. At the same time, the two photosensors 60, 60 are integrally moved with the guide plates 12, 12 in the direction of arrow B, and the distance between the reading positions at the fore end of the document can be extended (i.e., increased) or narrowed (i.e., decreased) in accordance with the size of the document which is to be read. Accordingly, whether or not the document is skewed, is judged by detecting a time difference between the respective time at which the two photosensors 60, 60 individually detect the fore end of the document. In this case, when the size of the document is large, the skew of the document can be advantageously detected in the form of a larger difference in the detecting times.

The photosensors 60, 60 are disposed somewhat ahead of the reading position 33 (FIG. 1). In the case where the document is skewed, an operation is executed in the following manner so as to correct the skewed document:

When a detecting time difference of the fore end of the document detected by the two photosensors 60, 60, has exceeded a predetermined value, the pair of conveyance rollers 24*c* and pinch rollers 25*c*, which are disposed somewhat behind the reading position 33, are stopped, and the pinch rollers 25*b* disposed ahead of the reading position 33 are opened from the conveyance roller 24*b* of the related pairs, so that the document is put in a free condition. After a predetermined period of time has passed, the fore end of the document is regulated by the conveyance rollers 24*b* and the pinch rollers 25*b* so that the document can be aligned by these rollers. Of course, it is possible to adjust the operation time of alignment in which the document is aligned, depending on an amount of skew. In this case, it is possible in this embodiment that the skew adjusting time can be adjusted so as to correspond to the detection time difference between the two photosensors 60, 60. In another embodiment, only one of the right and left guide plates 12, 12 and the corresponding photosensor may be moved in the horizontal direction and, on the other hand, the other guide plate and its corresponding photosensor may be immovable in the horizontal direction.

Figure 7:
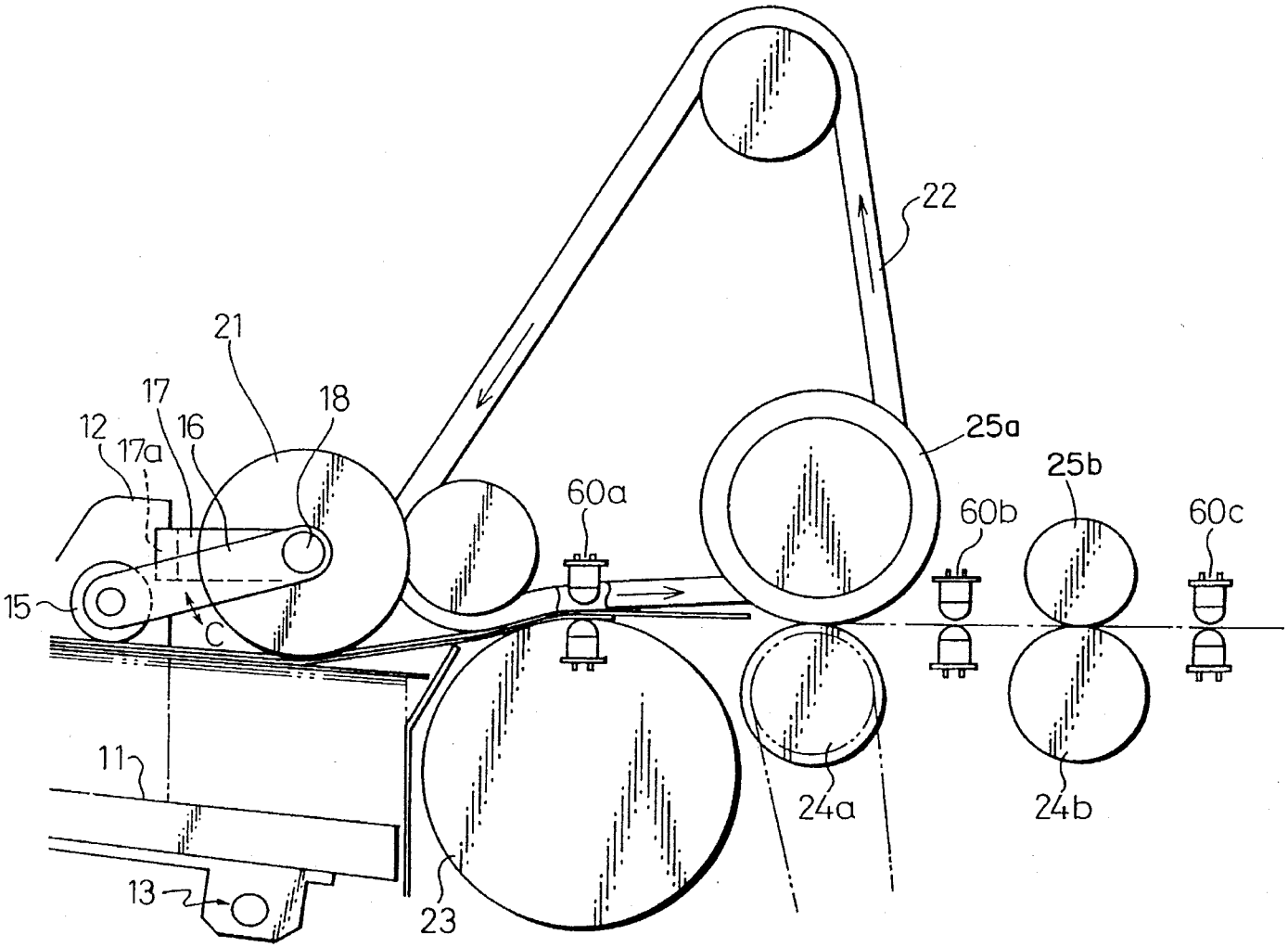
FIG. 7 is a side view of the document supply and conveyance mechanism relating to a second embodiment.
Figure 8:
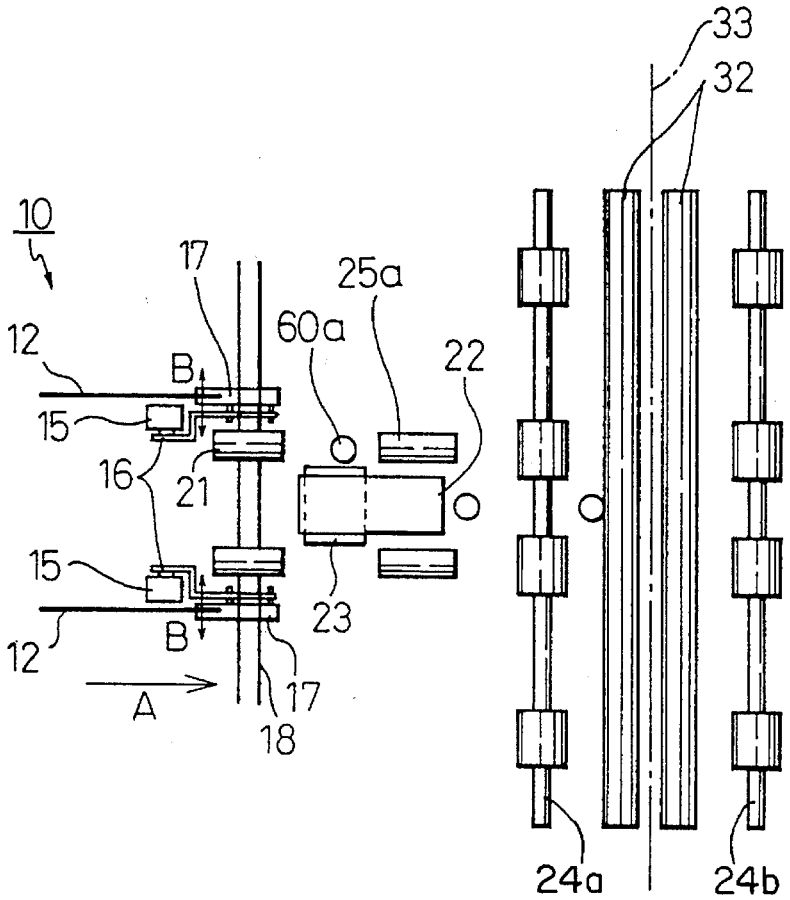
FIG. 8 is a plan view of the second embodiment.

With reference to FIGS. 7 and 8, a second embodiment of the present invention will be explained as follows. FIG. 7 is a side view of the document supply and conveyance mechanism relating to the second embodiment, and FIG. 8 is a plan view of the second embodiment. Same or corresponding parts in each of FIGS. 1 to 8 are identified by the same reference character, and the explanations of these parts are omitted here.

In FIGS. 7 and 8, in the same manner as that of the first embodiment, there are provided right and left guide plates 12, 12 for regulating the respective, opposite sides of the sheets of paper stacked in the hopper 11, and the right and left guide plates 12, 12 are provided in such a manner that they can be slidingly moved along a shaft 13 in the horizontal direction B perpendicular to the sheet advancing direction A. That is to say, each of the guide plates 12, 12 engages with a vertical groove 17*a* (FIG. 7) provided at the end of a corresponding connecting member 17, so that each guide plate 12 is allowed to be raised or lowered in accordance with the vertical movement of the hopper 11 depending on the amounts of sheets supported on the hopper 11. In the second embodiment, there are provided right and left guide rollers 15, 15 for pressing against the uppermost document at respective positions close to the opposite sides (i.e., longitudinal edges) both sides of the document in the rear of the picking rollers 21, 21 with respect to the conveyance direction A.

Each guide roller 15 is rotatably attached to an end of a corresponding arm 16. The other end of this arm 16 is pivotally attached to a shaft 18 of the picking rollers 21, 21. Therefore, the guide capable of being moved up and down together with the picking rollers 21, 21. Also, each guide roller 15 is connected with the connecting member 17, in such a manner that each guide roller 15 is moved together with the guide plate 12 in the horizontal direction as shown by an arrow B, but is allowed to move up and down with respect to each guide plate 12.

Consequently, when documents of a large size are used, the distance between the right and left guide plates 12, 12 is extended. At this time, the distance between the right and left guide rollers 15, 15 is simultaneously extended. On the contrary, when documents of a small size are used, the distance between the right and left guide plates 12, 12 is narrowed. At this time, the distance between the right and left guide rollers 15, 15 is simultaneously narrowed. Therefore, in accordance with the size of the document, the guide rollers 15, 15 are automatically adjusted so as to press against the corresponding positions adjacent the opposite longitudinal edges, or sides, of the uppermost document, in such a manner that the document can be prevented from rising upward.

As the number of stacked documents reduces, the picking roller is lowered, and also the right and left guide rollers 15, 15 are lowered. Therefore, the edges of the uppermost document are pressed by an appropriate pressing force at all times. In this connection, the document may be pressed by the action of the guide rollers 15, 15 and the arms 16, 16. When necessary, appropriate springs (not shown in the drawings) are attached to the arms 16, so that the pressing force against the document my be increased.

In another embodiment, only one the right and left guide plates 12, 12 and the corresponding guide roller 15 may be moved in the horizontal direction, as mentioned above.

Figure 9:
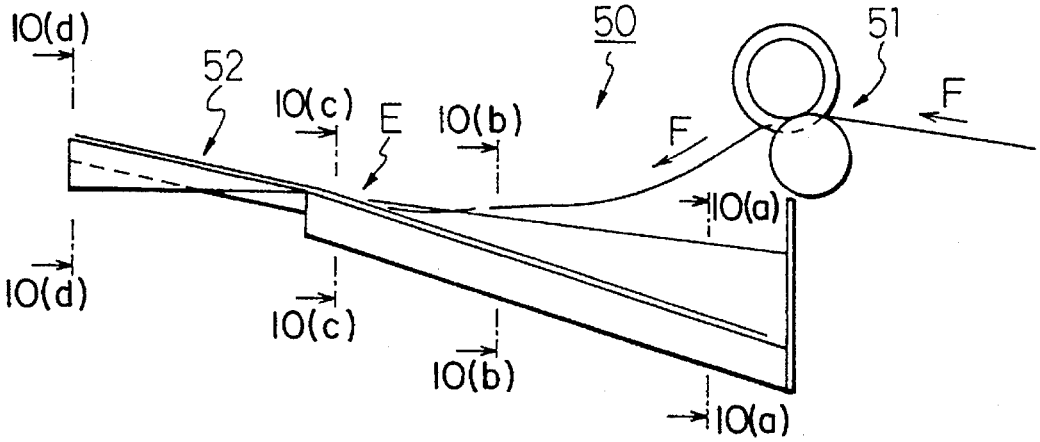
FIG. 9 is a side view showing an outline of the document discharging and stacking section relating to a third embodiment of the present invention.
Figure 10A:
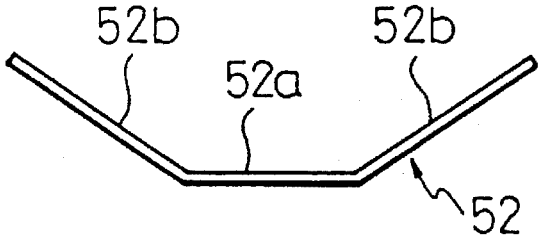
FIGS. 10(*a*) to 10(*d*) are sectional views respectively showing each portion of the stacking section of Example 3 shown in FIG. 9.
Figure 10B:
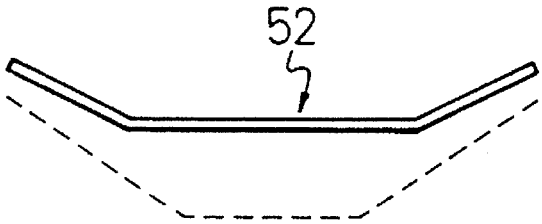
Figure 10C:
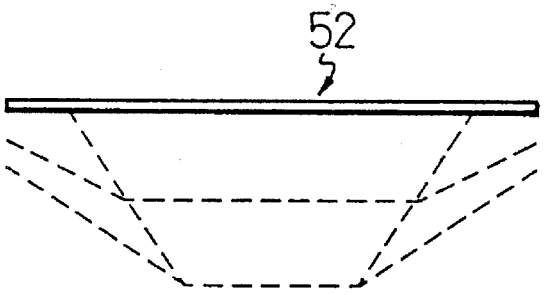
Figure 10D:
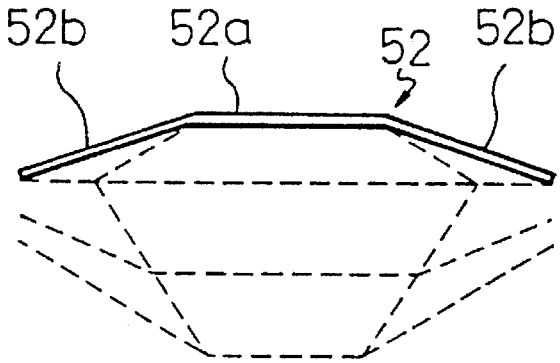

Next, with reference to FIGS. 9 and 10, a third embodiment of the present invention will be explained as follows. FIG. 9 is a side view showing an outline of the document discharging and stacking section 50 of the third embodiment, and FIGS. 10(*a*) to 10(*d*) are sectional views of respective portions of the device shown in FIG. 9. Same or corresponding parts in each of FIGS. 9 and 10 are identified by the same reference character, and the explanations of these parts are omitted here.

In the document discharging and stacking section 50, conveyed documents are discharged by the discharging roller 51 in the direction of arrow F and successively stacked on the stacking surface of the stacking section 52. The stacking surface of the stacking section 52 is inclined in the following manner with respect to the discharging (i.e., document conveying) direction F, an upstream portion of the stacking surface is lower than the discharging position of the discharging roller 51, and the stacking surface is inclined upwardly progressing in the downstream direction.

FIGS. 10(*a*) to 10(*d*) illustrate successive cross-sections of a sheet in a direction perpendicular to the discharging direction F, which are formed as follows.

On the upstream side, the cross-section is approximately concave, and the widths of the inclined surfaces 52*b* on both sides are relatively large compared with the width of the bottom surface 52*a* (shown by FIG. 10(*a*)). The widths of the inclined surfaces 52*b* on the opposite sides are gradually reduced and the inclination is also reduced (shown by FIG. 10(*b*)). At the position E, the inclined surfaces 52*b* become approximately horizontal (shown by FIG. 10(*c*)). On the downstream side beyond the position E, the surfaces 52*b* on the opposite sides gently become convex and incline downwardly in the transverse direction with respect to the bottom surface 52*a* (shown by FIG. 10(*d*)).

When a document is discharged from the discharging roller 51 and dropped onto the stacking surface of the stacking section 52, the document follows the configuration of this stacking surface, so that the document is somewhat deformed. Especially at the position E, the document is subjected to a relatively high frictional resistance. Due to the foregoing, movements of documents of various sizes (for example, from the size A3 to the size A8) are reduced, so that the documents are prevented from scattering. Therefore, the documents are stacked in alignment.

Some embodiments of the present invention have been explained above with reference to the accompanying drawings. However, it should be understood that the present invention is not limited to the specific embodiments, and variations and modifications may be made by one skilled in the art without departing from the spirit and scope of the present invention as claimed in this application.

I claim:

1. A mechanism for conveying and stacking sheets, comprising:

conveyance means for conveying sheets along a conveying path, form an upstream end to a downstream, discharge end of the conveying path thereby to discharge the conveyed sheets in a discharging direction at the downstream, discharge end; and a stacking station having a stacking surface with an upstream end disposed below the discharge end of the conveying pat and a downstream end displaced from the upstream end in the discharging direction, the discharged sheets moving in the discharging direction from the discharge end and onto and along the stacking surface of the stacking station and being stacked thereon, the stacking surface being inclined in such a manner that the upstream end of the stacking surface relative to the discharging direction is lower than the discharge end of said conveying path and the stacking surface is inclined upwardly, progressing from the upstream end to the downstream end thereof, the stacking surface having a variable cross-section in successive planes, perpendicular to and spaced along the discharging direction, smoothly changing from approximately concave at the upstream end thereof to convex at the downstream end thereof.

2. A stacking mechanism for stacking sheets in layers, said mechanism comprising:

a conveying path along which said sheets are conveyed in a conveying direction, from an upstream end to a downstream end of the conveying path, the conveyed sheets being discharged from the downstream end; and a stacking surface having an upstream end disposed at the downstream end of the conveying path and onto which the sheets are discharged, in the conveying direction, and stacked, said stacking surface having a variable cross-section, in successive planes perpendicular to and spaced along the conveying path in the conveying direction, progressing smoothly from a concave cross-section at the upstream end of the stacking surface to a convex cross-section at a downstream end of the stacking surface.

3. A stacking mechanism as set forth in claim 2, wherein said variable cross-section of the stacking surface is defined by a central portion which is substantially planar, the upstream end of which is lower than the downstream end of the conveying path and which central portion is inclined upwardly, extending toward the downstream end thereof, and has spaced, opposite edges extending from the upstream to the downstream ends thereof and first and second, angled and symmetrical side portions connected to and extending outwardly from the respective first and second edges of said central portion.

4. A stacking mechanism as set forth in claim 3, wherein said angled side portions are inclined upwardly from said central portion at the upstream end and are inclined downwardly from said central portion at the downstream end of the stacking surface, thereby defining the variable cross-section of the stacking surface.

5. A stacking mechanism as set forth in claim 3, wherein said angled side portions are increasingly, downwardly inclined, progressing toward the downstream end of the stacking surface in the sheet conveying direction.

6. A stacking mechanism as set forth in claim 3, wherein said central portion of said stacking surface comprises a first subportion extending from the upstream end thereof to an intermediate position and a second subportion extending from the intermediate position to the downstream end thereof, the first and second subportions being inclined angularly upwardly at respective first and second angles relatively to a horizontal reference, the first angle being greater than the second angle.

* * * * *

UNITED STATES PATENT AND TRADEMARK OFFICE

CERTIFICATE OF CORRECTION

PATENT NO. : 5,618,034

DATED : Apr. 8, 1997

INVENTOR(S) : TAKASHIMIZU

It is certified that error appears in the above-indentified patent and that said Letters Patent is hereby corrected as shown below:

Col. 1, line 19, after "scanner" insert --,--;
line 28, after "up" insert --,--; and after "one" (second occurrence) insert --,--;
line 49, delete "when".

Col. 2, line 15, after "of" insert --any--;
lines 39-40, change "directions" to --direction,--.

Col. 4, line 35, after "hopper" insert --11--.

Col. 5, line 27, change "time" to --times--.

Col. 6, line 11, change "amounts" to --amount--;
line 15, delete "both sides";
line 21, after "guide" insert --rollers 15 are--;
line 51, after "one" insert --of--.

Col. 7, line 2, change "manner with" to --manner. With--;
line 8, after "sheet" insert --,--;
line 43 (Claim 1, line 4), change "form" to --from--;
line 49 (Claim 1, line 10), change "pat" to --path--.

Signed and Sealed this

Twenty-sixth Day of August, 1997

*Attest:*

Bruce Lehman

BRUCE LEHMAN

*Attesting Officer*

*Commissioner of Patents and Trademarks*